US010647936B2

(12) United States Patent
Blumenfeld et al.

(10) Patent No.: US 10,647,936 B2
(45) Date of Patent: May 12, 2020

(54) METHOD FOR IMPROVING LUBRICANT ANTIFOAMING PERFORMANCE AND FILTERABILITY

(71) Applicant: ExxonMobil Research and Engineering Company, Annandale, NJ (US)

(72) Inventors: Michael L. Blumenfeld, Haddonfield, NJ (US); Angela S. Galiano-Roth, Mullica Hill, NJ (US); Wenning W. Han, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 142 days.

(21) Appl. No.: 15/846,505

(22) Filed: Dec. 19, 2017

(65) Prior Publication Data

US 2018/0245008 A1 Aug. 30, 2018

Related U.S. Application Data

(60) Provisional application No. 62/440,457, filed on Dec. 30, 2016.

(51) Int. Cl.
*C10M 101/02* (2006.01)
*C10M 107/02* (2006.01)
(Continued)

(52) U.S. Cl.
CPC ..... *C10M 101/02* (2013.01); *C10M 107/02* (2013.01); *C10M 155/02* (2013.01);
(Continued)

(58) Field of Classification Search
CPC ..... C10M 101/02; C10M 107/02; C10M 155/02; C10M 171/004; C10M 2209/023;
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A 1/1981
EP 0464547 A1 7/1990
(Continued)

*Primary Examiner* — Cephia D Toomer
(74) *Attorney, Agent, or Firm* — Robert A. Migliorini

(57) ABSTRACT

A method for improving filterability, while maintaining or improving antifoaming performance, of a lubricating oil in an engine or other mechanical component lubricated with the lubricating oil by using as the lubricating oil a formulated oil. A method for improving antifoaming performance, while maintaining or improving filterability, of a lubricating oil in an engine or other mechanical component lubricated with the lubricating oil by using as the lubricating oil a formulated oil. The formulated oil has a composition including a lubricating oil base stock as a major component, and at least one antifoam agent, as a minor component. A lubricating oil having a composition including a lubricating oil base stock as a major component, and at least one antifoam agent, as a minor component. The antifoam agent is a silicone composition having a highly branched functionalized silicone backbone. The lubricating oils are useful as automotive gear lubricating compositions.

30 Claims, 2 Drawing Sheets

| *Fresh Oil Properties* | | | | *Reference* | |
|---|---|---|---|---|---|
| | Defoamant Tested: | 30 ppm D1-100 | 30 ppm D10 | 30 ppm PDMS | None |
| Measurement | Method/Midas | 12-19812 / 12-26424 | 12-19817 / 12-26423 | 12-45023 / 12-26599/ 12-63027 | 12-19818 |
| Appearance | AMS1738 | Slight Haze | Clear & Bright | Slight Haze | Clear & Bright |
| Silicon, ppm | D5185/ASV | 11 | 3.9 | 11 | 0.64 |
| Tendency/Stability, ml | D892 Seq I | 0/0 | 0/0 | 0/0 | 390/210 |
| Tendency/Stability, ml | D892 Seq II | 0/0 | 0/0 | 0/0 | 520/0 |
| Tendency/Stability, ml | D892 Seq III | 0/0 | 0/0 | 0/0 | 530/250 |
| % tot. vol. increase after 5 min | Flender Foam | 7.5 | 10 | 6 | - |
| % volume increase @ 20 sec | LOAST | 8 | 5 | 5 | 120 |
| % volume increase @ 5 min | LOAST | 3 | 5 | 2 | 115 |
| % volume increase @ 30 min | LOAST | 0 | 0 | 0 | 100 |
| % volume increase @ 120 min | LOAST | 0 | 0 | 0 | 0 |
| *Filtered Oil Properties* | | | | *Reference* | |
| Measurement | Method/Midas | 12-31314 | 12-29308 | 12-33003 | - |
| Silicon, ppm | D5185/ASV | 4.7 | 2.4 | 0.62 | - |
| % Si Retention | Calc. | 43% | 62% | 6% | - |
| Tendency/Stability, ml | D892 Seq I | 0/0 | 0/0 | 530/400 | - |
| Tendency/Stability, ml | D892 Seq II | 660/0 | 680/0 | 560/0 | - |
| Tendency/Stability, ml | D892 Seq III | 160/30 | 200/30 | 270/30 | - |
| % tot. vol. increase after 5 min | Flender Foam | 14 | 20 | 24 | - |
| % volume increase @ 20 sec | LOAST | 9.3 | 17.5 | 57.5 | - |
| % volume increase @ 5 min | LOAST | 4.65 | 15 | 52.5 | - |
| % volume increase @ 30 min | LOAST | 2.33 | 7.5 | 50 | - |
| % volume increase @ 120 min | LOAST | 0 | 0 | 0 | - |

(51) Int. Cl.
*C10M 155/02* (2006.01)
*C10M 171/00* (2006.01)

(52) U.S. Cl.
CPC ..... *C10M 171/004* (2013.01); *C10M 2203/1006* (2013.01); *C10M 2205/0285* (2013.01); *C10M 2209/023* (2013.01); *C10M 2229/041* (2013.01); *C10M 2229/048* (2013.01); *C10N 2230/18* (2013.01); *C10N 2240/04* (2013.01); *C10N 2240/10* (2013.01)

(58) Field of Classification Search
CPC .... C10M 2229/048; C10M 2203/1006; C10M 2205/0285; C10M 2229/041; C10N 2240/04; C10N 2230/18; C10N 2240/10
See application file for complete search history.

(56) References Cited

U.S. PATENT DOCUMENTS 2,100,993 A 11/1937 Bruson
2,191,498 A 2/1940 Reiff
2,387,501 A 10/1945 Dietrich
2,655,479 A 10/1953 Munday et al.
2,666,746 A 1/1954 Munday et al.
2,721,877 A 10/1955 Popkin et al.
2,721,878 A 10/1955 Popkin
2,817,693 A 12/1957 Koome et al.
3,036,003 A 5/1962 Verdol
3,087,936 A 4/1963 LeSuer
3,172,892 A 3/1965 LeSuer et al.
3,200,107 A 8/1965 LeSuer
3,215,707 A 11/1965 Rense
3,219,666 A 11/1965 Norman et al.
3,250,715 A 5/1966 Wyman
3,254,025 A 5/1966 LeSuer
3,272,746 A 9/1966 LeSuer et al.
3,275,554 A 9/1966 Wagenaar
3,316,177 A 4/1967 Dorer, Jr.
3,322,670 A 5/1967 Burt et al.
3,329,658 A 7/1967 Fields
3,341,542 A 9/1967 LeSuer et al.
3,382,291 A 5/1968 Brennan
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 van der Voort et al.
3,454,607 A 7/1969 LeSuer et al.
3,519,565 A 7/1970 Coleman
3,541,012 A 11/1970 Stuebe
3,565,804 A 2/1971 Honnen et al.
3,595,791 A 7/1971 Cohen
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,742,082 A 6/1973 Brennan
3,751,365 A 8/1973 Piasek et al.
3,755,433 A 8/1973 Miller et al.
3,756,953 A 9/1973 Piasek et al.
3,769,363 A 10/1973 Brennan
3,787,374 A 1/1974 Adams
3,798,165 A 3/1974 Piasek et al.
3,803,039 A 4/1974 Piasek et al.
3,822,209 A 7/1974 Knapp et al.
3,876,720 A 4/1975 Heilman et al.
3,948,800 A 4/1976 Meinhardt
4,100,082 A 7/1978 Clason et al.
4,149,178 A 4/1979 Estes
4,218,330 A 8/1980 Shubkin
4,234,435 A 11/1980 Meinhardt et al.
4,239,930 A 12/1980 Allphin et al.
4,367,352 A 1/1983 Watts, Jr. et al.
4,413,156 A 11/1983 Watts, Jr. et al.
4,426,305 A 1/1984 Malec
4,434,408 A 2/1984 Baba et al.
4,454,059 A 6/1984 Pindar et al.
4,594,172 A 6/1986 Sie
4,725,658 A * 2/1988 Thayer ..... A61K 8/893 528/15
4,767,551 A 8/1988 Hunt et al.
4,798,684 A 1/1989 Salomon
4,827,064 A 5/1989 Wu
4,827,073 A 5/1989 Wu
4,897,178 A 1/1990 Best et al.
4,910,355 A 3/1990 Shubkin et al.
4,921,594 A 5/1990 Miller
4,943,672 A 7/1990 Hammer et al.
4,952,739 A 8/1990 Chen
4,956,122 A 9/1990 Watts et al.
5,068,487 A 11/1991 Theriot
5,075,269 A 12/1991 Degnan et al.
5,084,197 A 1/1992 Galic et al.
5,430,105 A 7/1995 Redpath et al.
5,705,458 A 1/1998 Roby et al.
6,034,039 A 3/2000 Gomes et al.
6,080,301 A 6/2000 Berlowitz et al.
6,090,989 A 7/2000 Trewella et al.
6,165,949 A 12/2000 Berlowitz et al.
6,323,164 B1 11/2001 Liesen et al.
7,704,930 B2 4/2010 Deckman et al.
7,776,206 B2 8/2010 Miller et al.
7,790,813 B2 9/2010 O'Lenick et al.
7,906,671 B2 3/2011 Pafford et al.
8,048,833 B2 11/2011 Habeeb et al.
8,071,514 B2 12/2011 Han et al.
2008/0020950 A1 1/2008 Gray et al.

FOREIGN PATENT DOCUMENTS

EP 0471071 B1 8/1995
GB 1350257 A 4/1974
GB 1390359 A 4/1975
GB 1429494 A 3/1976
GB 1440230 A 6/1976

* cited by examiner

Fig. 1

| *Fresh Oil Properties* | | | | *Reference* | |
|---|---|---|---|---|---|
| | Defoamant Tested: | 30 ppm DI-100 | 30 ppm D10 | 30 ppm PDMS | None |
| **Measurement** | **Method/Midas** | 12-19812 / 12-26424 | 12-19817 / 12-26423 | 12-45023 / 12-26599/ 12-63027 | 12-19818 |
| Appearance | AMS1738 | Slight Haze | Clear & Bright | Slight Haze | Clear & Bright |
| Silicon, ppm | D5185/ASV | 11 | 3.9 | 11 | 0.64 |
| Tendency/Stability, ml | D892 Seq I | 0/0 | 0/0 | 0/0 | 390/210 |
| Tendency/Stability, ml | D892 Seq II | 0/0 | 0/0 | 0/0 | 520/0 |
| Tendency/Stability, ml | D892 Seq III | 0/0 | 0/0 | 0/0 | 530/250 |
| % tot. vol. increase after 5 min | Flender Foam | 7.5 | 10 | 6 | - |
| % volume increase @ 20 sec | LOAST | 8 | 5 | 5 | 120 |
| % volume increase @ 5 min | LOAST | 3 | 5 | 2 | 115 |
| % volume increase @ 30 min | LOAST | 0 | 0 | 0 | 100 |
| % volume increase @ 120 min | LOAST | 0 | 0 | 0 | 0 |
| *Filtered Oil Properties* | | | | *Reference* | |
| **Measurement** | **Method/Midas** | 12-31314 | 12-29308 | 12-33003 | - |
| Silicon, ppm | D5185/ASV | 4.7 | 2.4 | 0.62 | - |
| % Si Retention | Calc. | 43% | 62% | 6% | - |
| Tendency/Stability, ml | D892 Seq I | 0/0 | 0/0 | 530/400 | - |
| Tendency/Stability, ml | D892 Seq II | 660/0 | 680/0 | 560/0 | - |
| Tendency/Stability, ml | D892 Seq III | 160/30 | 200/30 | 270/30 | - |
| % tot. vol. increase after 5 min | Flender Foam | 14 | 20 | 24 | - |
| % volume increase @ 20 sec | LOAST | 9.3 | 17.5 | 57.5 | - |
| % volume increase @ 5 min | LOAST | 4.65 | 15 | 52.5 | - |
| % volume increase @ 30 min | LOAST | 2.33 | 7.5 | 50 | - |
| % volume increase @ 120 min | LOAST | 0 | 0 | 0 | - |

METHOD FOR IMPROVING LUBRICANT ANTIFOAMING PERFORMANCE AND FILTERABILITY

CROSS-REFERENCE TO RELATED APPLICATIONS

This application claims priority to U.S. Provisional Application Ser. No. 62/440,457 filed Dec. 30, 2016, which is herein incorporated by reference in its entirety.

FIELD

This disclosure relates to a method for improving lubricant antifoaming performance and filterability. This disclosure also relates to a lubricating oil having a lubricating oil base stock and at least one antifoam agent (i.e., a silicone composition). The lubricating oils of this disclosure are useful in engines or other mechanical components lubricated with the lubricating oils (e.g., gear oils).

BACKGROUND

A major challenge in oil formulation is simultaneously achieving desired lubricant antifoaming performance and filterability in filtered applications.

Defoamants are added to lubricants to prevent foam generation in service. Foam is a concern of lubricant end users due to: interference with lubricant-level monitoring; concern over entrained air interfering with lubricant film thickness; cosmetic issues (foam is easily visible and can indicate contamination); potential for spill-over (slippery spots); and the like. In particular, foam is a significant concern in gear oils as it prevents accurate measurement of the lubricant level.

The current state of the art is the use of methylated silicones namely polydimethylsiloxanes (PDMSs). However, the PDMSs have a low refractive index, high density, high Si content, and are removed by common filter material (including cellulosic and glass fiber media).

Despite advances in lubricant oil formulation technology, there exists a need for an oil lubricant that can effectively achieve both good lubricant antifoaming performance and filterability in filtered applications.

SUMMARY

This disclosure relates in part to a method for improving filterability, while maintaining or improving antifoaming performance, of a lubricating oil in an engine or other mechanical component lubricated with the lubricating oil by using as the lubricating oil a formulated oil. The formulated oil has a composition comprising a lubricating oil base stock as a major component, and at least one antifoam agent, as a minor component. The antifoam agent comprises a silicone composition having the formula:

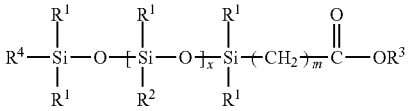

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

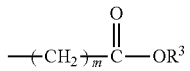

and a reverse ester thereof represented by the formula:

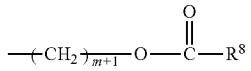

and the formula:

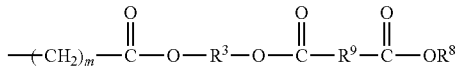

and a reverse ester thereof represented by the formula:

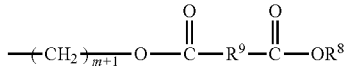

provided that if $R^1$ is anything but methyl or ethyl, then $R^2$ must be a methyl, ethyl or butyl. $R^3$ is derived from a partially esterified ester residue; $R^8$ is selected from the group consisting of hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, in is an integer between about 5 to about 22; and x is an integer between about 0 to about 1000; wherein the composition has at least 1 compound derived from the partially esterified ester-containing group or the reverse ester thereof.

In accordance with this disclosure, filterability is improved, and antifoam performance is maintained or improved, as compared to filterability and antifoam performance achieved using a lubricating oil containing a minor component other than the antifoam agent.

This disclosure also relates in part to a lubricating oil having a composition comprising a lubricating oil base stock as a major component, and at least one antifoam agent, as a minor component. The antifoam agent comprises a silicone composition having the formula:

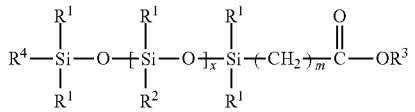

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

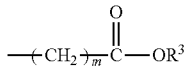

and a reverse ester thereof represented by the formula:

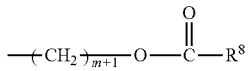

and the formula:

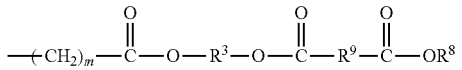

and a reverse ester thereof represented by the formula:

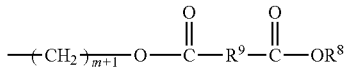

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, in is an integer between about 5 to about 22; and x is an integer between about 0 to about 1000; wherein the composition has at least 1 compound derived from the partially esterified ester-containing group or the reverse ester thereof.

This disclosure further relates in part to a method for improving antifoaming performance, while maintaining or improving filterability, of a lubricating oil in an engine or to other mechanical component lubricated with the lubricating oil by using as the lubricating oil a formulated oil. The formulated oil has a composition comprising a lubricating oil base stock as a major component, and at least one antifoam agent, as a minor component. The antifoam agent comprises a silicone composition having the formula:

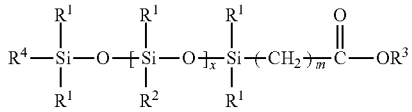

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

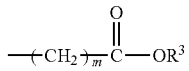

and a reverse ester thereof represented by the formula:

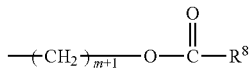

and the formula:

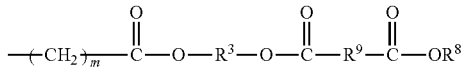

and a reverse ester thereof represented by the formula:

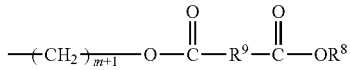

provided that if $R^1$ is anything but methyl or ethyl, then $R^2$ must be a methyl, ethyl or butyl, $R^3$ is derived from a partially esterified ester residue; $R^8$ is selected from the group consisting of hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, m is an integer between about 5 to about 22; and x is an integer between about to about 1000; wherein the composition has at least 1 compound derived from the partially esterified ester-containing group or the reverse ester thereof.

In accordance with this disclosure, antifoam performance is improved, and filterability is maintained or improved, as compared to antifoam performance and filterability achieved using a lubricating oil containing a minor component other than the antifoam agent.

It has been surprisingly found that, in accordance with this disclosure, the defoamants DI-100 and D10 of this disclosure exhibited antifoam performance comparable to polydimethylsiloxanes (PDMS) in fresh oil foam performance tests. Also, it has been surprisingly found that DI-100 and D10 are superior to PDMS in filterability in that they are not retained by standard filter material. Further, it has been surprisingly found that formulations containing DI-100 and D10 retain substantial antifoam performance post-filtration. Still further, it has been surprisingly found that increasing hydrocarbon content of Si-based defoamants reduces haze in finished formulations. Yet further, it has been surprisingly found that silicone derivatized esters provide exceptional antifoam performance, reduce Si content required for efficacy (valuable for certain applications), and improve filter compatibility.

Other objects and advantages of the present disclosure will become apparent from the detailed description that follows.

BRIEF DESCRIPTION OF THE DRAWINGS

FIG. 1 is a summary of pre-filtration (top) and post-filtration (bottom) foam performance for formulations containing silicone derivatized ester defoamants of this disclosure versus PDMS reference and defoamant-free control.

DETAILED DESCRIPTION

Figure 2:
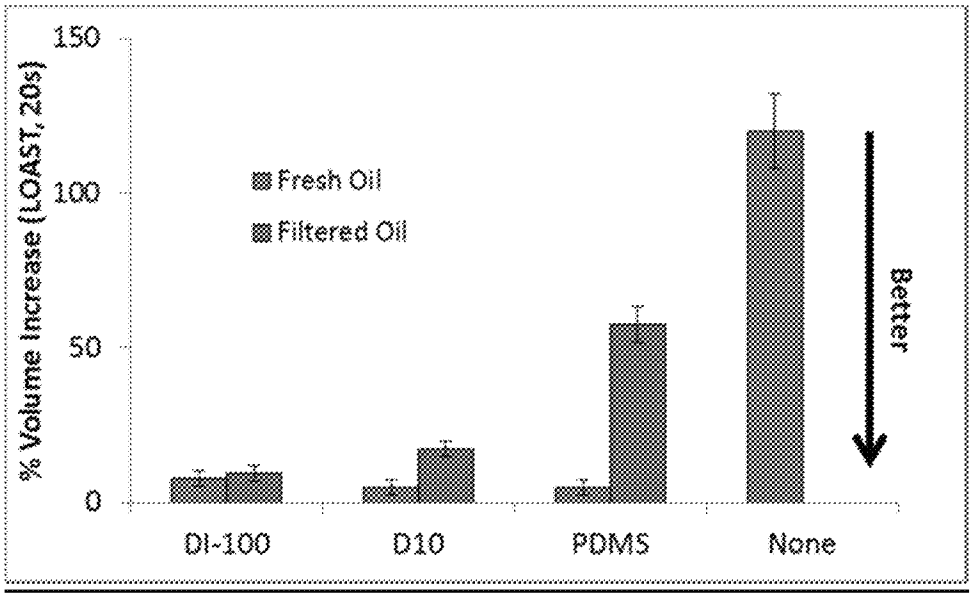
FIG. 2 is pre-filtration (Blue) and post-filtration (Red) foam performance for formulations containing silicone derivatized ester defoamants of this disclosure versus PDMS reference and defoamant-free control.

All numerical values within the detailed description and the claims herein are modified by "about" or "approximately" the indicated value, and take into account experimental error and variations that would be expected by a person having ordinary skill in the art.

In accordance with this disclosure, it has now been found that improved filterability can be attained, while antifoaming performance is unexpectedly maintained or improved, in an engine or other mechanical component lubricated with a lubricating oil by using as the lubricating oil a formulated oil. The formulated oil has a composition comprising a lubricating oil base stock as a major component, and at least one antifoam agent, as a minor component. The antifoam agent comprises a silicone composition having the formula:

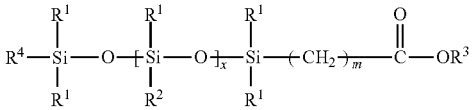

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

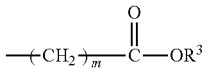

and a reverse ester thereof represented by the formula:

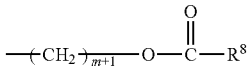

and the formula:

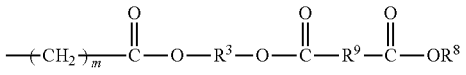

and a reverse ester thereof represented by the formula:

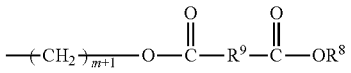

provided that if $R^1$ is anything but methyl or ethyl, then $R^2$ must be a methyl, ethyl or butyl. $R^3$ is derived from a partially esterified ester residue; $R^8$ is selected from the group consisting of hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, in is an integer between about 5 to about 22; and x is an integer between about 0 to about 1000; wherein the composition has at least 1 compound derived from the partially esterified ester-containing group or the reverse ester thereof.

In an embodiment, filterability is improved, and antifoam performance is maintained or improved, as compared to filterability and antifoam performance achieved using a lubricating oil containing a minor component other than the antifoam agent e.g., a PDMS).

Also, in accordance with this disclosure, it has now been found that improved antifoaming performance can be attained, while filterability is unexpectedly maintained or improved, in an engine or other mechanical component lubricated with a lubricating oil by using as the lubricating oil a formulated oil. The formulated oil has a composition comprising a lubricating oil base stock as a major component, and at least one antifoam agent, as a minor component. The antifoam agent comprises a silicone composition having the formula:

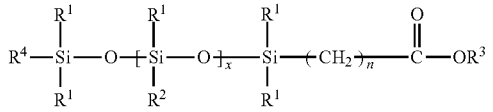

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

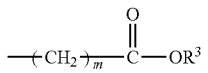

and a reverse ester thereof represented by the formula:

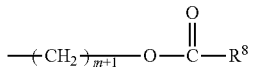

and the formula:

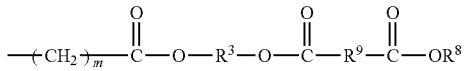

and a reverse ester thereof represented by the formula:

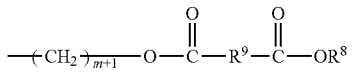

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, m is an integer between about 5 to about 22; and x is an integer between about 0 to about 1000; wherein the composition has at least 1 compound derived from the partially esterified ester-containing group or the reverse ester thereof.

In an embodiment, antifoam performance is improved, and filterability is maintained or improved, as compared to antifoam performance and filterability achieved using a lubricating oil containing a minor component other than the antifoam agent.

The lubricating oils of this disclosure are particularly advantageous as automotive gear lubricating compositions.

In accordance with this disclosure, silicone compositions having a highly branched functionalized silicone backbone exhibit antifoam performance comparable to PDMS in fresh oil foam performance tests. Also, in accordance with this disclosure, the silicone compositions having a highly branched functionalized silicone backbone are superior to PDMS in filterability in that they are not retained by standard filter material. Further, in accordance with this disclosure, lubricant formulations containing the silicone compositions having a highly branched functionalized silicone backbone retain substantial antifoam performance post-filtration. Still further, in accordance with this disclosure, it has been surprisingly found that increasing hydrocarbon content of the silicone compositions having a highly branched functionalized silicone backbone reduces haze in finished formulations. Yet further, it has been surprisingly found that the silicone compositions having a highly branched functionalized silicone backbone of this disclosure provide exceptional antifoam performance, reduce Si content (valuable for certain applications), and improve filter compatibility.

As used herein, filtration involves using some method to remove suspended contamination from oil for either the protection of equipment (screening) or extending the life of the oil (cleaning). There are two types of oil filtration, namely, primary oil filtration (screening) and secondary filtration (cleaning). The two types of oil filtration serve two very different purposes and are very different as a result.

Primary filtration is designed for equipment protection and is usually installed by the original equipment manufacturer. This type of filtration is almost always full flow with a bypass valve and is designed to keep out large particle contamination (many times 25 micron and larger). This is why it is referred to as oil screening. Its purpose is not to keep the oil clean at very low ISO cleanliness levels, but to keep large particles from damaging the lubricated equipment. Generally, primary filtration will be installed in the equipment lubrication circuit, either in the pressure line going out to the lubrication point(s) or the return line from the lubrication point(s). Because of this, primary filtration cannot be constructed in such a way to restrict flow to a level that would deny the equipment proper lubrication. The filter media is generally very porous and when the media becomes blocked with contamination, the internal bypass valve will open allowing unfiltered oil to exit the filter and reach the equipment Secondary filtration is designed for extending the life of the oil by cleaning it. This is also referred to as oil purification. The advantage of oil purification is not only extending the life of the oil, but also extending the life of the equipment with clean oil. There are several methods of oil purification. Sometimes original equipment manufacturers will include secondary filtration. Generally secondary filtration will be an add on aftermarket system and will be an off-line, side stream or kidney loop configuration. Secondary filtration will also usually clean oil down to very low ISO cleanliness levels that primary filtration cannot. Some examples of oil cleaning or purification are centrifugal, magnetic, vacuum dehydration, depth filter media or full flow filter media.

Primary filtration is important, and with very rare exceptions, OEM filtration should not be altered. Secondary filtration can add great benefit to the equipment owner by extending the life of the oil in the system and the equipment. Primary filtration will help protect the equipment investment whereas secondary filtration helps to maximize the return on the equipment investment, and maximize the return on the oil investment. With the continued rise in equipment costs, down time costs and oil replacement costs, adding secondary filtration to equipment can be very important for the equipment owner.

The lubricating oils of this disclosure are particularly advantageous for use in equipment having primary filtration, secondary filtration, or both primary and secondary filtration.

The lubricant compositions of this disclosure are useful in additive concentrates that include the minor component (i.e., antifoam agent) of this disclosure, having combined weight % concentrations in the range of 1% to 80%, preferably 1% to 60%, more preferably 1% to 50%, even more preferably 1% to 40%, and in some instances preferably 1% to 30%. Under some circumstances, the weight % concentrations cited above may be in the range of 1% to 20%, and preferably 1% to 10%.

Further, in accordance with this disclosure, a lubricating oil is provided having a composition comprising a lubricating oil base stock as a major component, and at least one antifoam agent, as a minor component. The lubricating oil base stock comprises a Group I, Group II. Group III, Group IV or Group V base oil. The antifoam agent comprises a silicone composition having the formula:

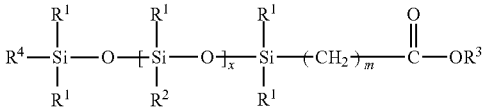

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

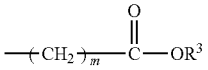

and a reverse ester thereof represented by the formula:

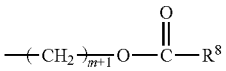

and the formula:

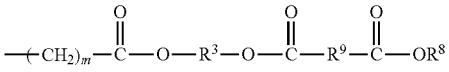

and a reverse ester thereof represented by the formula:

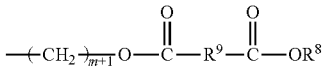

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, m is an integer between about 5 to about 22; and x is an integer between about 0 to about 1000; wherein the composition has at least 1 compound derived from the partially esterified ester-containing group or the reverse ester thereof.

Lubricating Oil Base Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a teed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | | polyalphaolefins (PAO) | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene. 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{12}$ to $C_{18}$ may be used to provide low viscosity base stocks of acceptably low volatility. Depending on the viscosity grade and the starting oligomer, the PAOs may be predominantly dimers, trimers and tetramers of the starting olefins, with minor amounts of the lower and/or higher oligomers, having a viscosity range of 1.5 cSt to 12 cSt. PAO fluids of particular use may include 3 cSt, 3.4 cSt, and/or 3.6 cSt and combinations thereof. Mixtures of PAO fluids having a viscosity range of 1.5 cSt to approximately 150 cSt or more may be used if desired. Unless indicated otherwise, all viscosities cited herein are measured at 100° C.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 2 cSt to about 50 cSt, preferably about 2 cSt to about 30 cSt, more preferably about 3 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl biphenyls, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 2 cSt to about 50 cSt are preferred, with viscosities of approximately 3 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Alkylated naphthalene and analogues may also comprise compositions with isomeric distribution of alkylating groups on the alpha and beta carbon positions of the ring structure. Distribution of groups on the alpha and beta positions of a naphthalene ring may range from 100:1 to 1:100, more often 50:1 to 1:50 Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxy lie acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, meristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorus and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group H stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 6 to about 99 weight percent or from about 6 to about 95 weight percent, preferably from about 50 to about 99 weight percent or from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 18 cSt (or $mm^2/s$) at 100° C. and preferably of about 2.5 cSt to about 12.5 cSt (or $mm^2/s$) at 100° C., often more preferably from about 2.5 cSt to about 10 cSt. Mixtures of synthetic and natural base oils may be used if desired. Bi-modal, tri-modal, and additional combinations of mixtures of Group I, II, III, IV, and/or V base stocks may be used if desired.

Antifoam Agents

In accordance with this disclosure, antifoam agents are advantageously added to lubricant compositions. These agents retard the formation of stable foams. Silicones and organic polymers are typical antifoam agents. Antifoam agents are conventional materials and are commercially available.

The antifoam agent of this disclosure is preferably a silicone composition having a highly branched functionalized silicone backbone. In particular, the antifoam agent comprises a silicone composition having the formula:

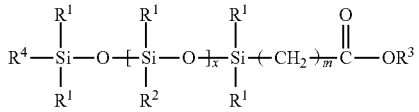

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

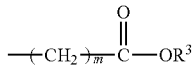

and a reverse ester thereof represented by the formula:

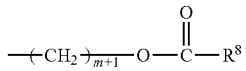

and the formula:

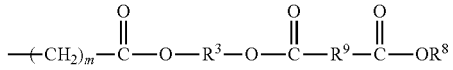

and a reverse ester thereof represented by the formula:

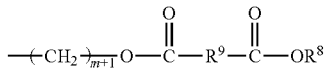

provided that if $R^1$ is anything but methyl or ethyl, then $R^2$ must be a methyl, ethyl or butyl, $R^3$ is derived from a partially esterified ester residue (e.g., for a partially esterified trimethylolpropane shown here, the residue is the structure without the remaining free hydroxyl group);

| Partial Ester | Residue |
|---|---|
| CH2OOC(CH2)$_5$CH3<br>\|<br>H5C2—C—CH2OH<br>\|<br>CH2OOC(CH2)$_5$CH3 | CH2OOC(CH2)$_5$CH3<br>\|<br>H5C2—C—CH2—<br>\|<br>CH2OOC(CH2)$_5$CH3 |

where in this case the two esterified groups on the molecule have been reacted with heptanoic acid; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, the ester-containing group and the compound derived from reverse esters thereof, m is an integer between about 5 to about 22; and x is an integer between about 0 to about 1000; wherein the composition has at least 1 compound derived from the partially esterified ester-containing group or the reverse ester thereof.

Preferably, $R^1$ and $R^2$ are both methyl groups and m is an integer between about 10 to about 14, preferably m is 10. Moreover, x is an integer in the range between about 6 to about 110, preferably between about 6 to about 50.

The compound derived from the partially esterified ester residue is a partially esterified alcohol. The mono-hydroxy-terminated partially esterified alcohol is derived from a poly-functional alcohol represented by the formula:

$$R^5(OH)_n$$

wherein: $R^5$ is an n-functional hydrocarbon; and n is from about 2 to about 8, preferably between about 2 to about 4.

The functional alcohol is preferably selected from the group consisting of: ethylene glycol, propylene glycol, butylene glycol, polyethylene glycol, neopentyl glycol, polypropylene glycol, glycerin, trimethylolethane, trimethylolpropane, pentaerythritol, di-pentaerythritol, tri-pentaerythritol, and a mixture thereof. The preferred functional alcohol is trimethylolpropane.

The compound derived from the partially esterified ester residue is a partially esterified acid. The mono-hydroxy-terminated partially esterified acid is derived from multi-functional acids. The functional acid can be selected from the group consisting of any C2 to C12 diacids, e.g., adipic, azelaic, sebacic, and dodecanedioc, succinic acid, glutaric acid, maleic acid, phthalic acid, trimellitic acid, nadic acid, methyl nadic acid, hexahydrophthalic acid, and mixtures thereof.

Anhydrides of polybasic acids can be used in place of the multifunctional acids. The functional anhydride is selected from the group consisting of: succinic anhydride, glutaric anhydride, adipic anhydride, maleic anhydride, phthalic anhydride, trimellitic anhydride, nadic anhydride, methyl nadic anhydride, hexahydrophthalic anhydride, and mixtures thereof.

$R^4$ is preferably a group represented by the formula:

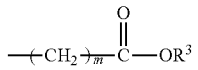

wherein: $R^3$ is a compound derived from a partially esterified ester residue; m is an integer in the range between about 5 to about 22; and x is an integer in the range between about 0 to about 1000, or a reverse ester thereof represented by the formula:

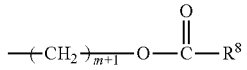

wherein $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue.

Alternatively, $R^8$ is a methyl group. The silicone composition represented by the formula:

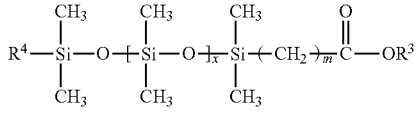

wherein: $R^4$ is selected from the group consisting of methyl and a group represented by the formula:

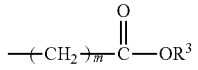

$R^3$ is a compound derived from a partial ester residue; m is 10; and x is an integer in the range between about 0 to about 1000, preferably about 6 to about 110.

$R^4$ is preferably a group represented by the formula:

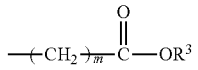

wherein $R^3$ is a compound derived from a partially esterified ester residue.

The partially esterified ester residue is derived from a mono-hydroxy-terminated partially esterified alcohol. The mono-hydroxy-terminated partially esterified alcohol is derived from di-, tri- or tetra-functional alcohol represented by the formula:

$$R^5(OH)_n$$

wherein: $R^5$ is an n-functional hydrocarbon residue; and n is an integer in the range between about 2 to about 8, preferably between about 2 to about 4.

Preferably, the di-, tri- or tetra-functional alcohol is selected from the group consisting of: ethylene glycol, propylene glycol, butylene glycol, polyethylene glycol, neopentyl glycol, polypropylene glycol, glycerin, trimethylolethane, trimethylolpropane, pentaerythritol, di-pentaerythritol, tri-pentaerythritol, and a mixture thereof.

Preferably, the functional alcohol is trimethylolpropane and $R^4$ is a group represented by the formula:

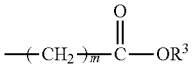

wherein: $R^3$ is a compound derived from a partially esterified ester residue; m is an integer in the range between about 5 to about 22; and x is an integer in the range between about 0 to about 1000, or a reverse ester thereof represented by the formula:

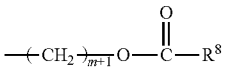

wherein $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue. Alternatively, $R^4$ is a methyl group.

The partially esterified ester is represented by the formula:

$$(R^7COO)_{m-1}R^6(OH)$$

wherein: $R^6$ is an (n−1)-functional hydrocarbon residue group; $R^7$ is a hydrocarbyl group; and n is an integer in the range between about 2 to about 8.

According to another embodiment of the present disclosure, a silicone composition is represented by the formula:

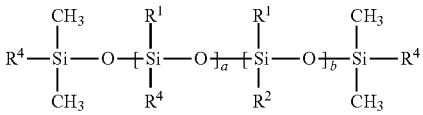

wherein $R^4$ is selected from the group consisting of: alkyl and a group represented by the formula:

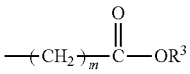

wherein: a is an integer in the range between about 1 to about 20; b is an integer in the range between about 0 to about 1000; $R^3$ is a compound derived from a partially esterified ester residue; and m is an integer in the range between about 5 to about 22; with the proviso that the $R^4$ groups are not all alkyls.

A preferred silicone composition of this disclosure is an (1) ester of undecylenic acid reacted with a partial ester of trimethylolpropane with a linear octanoic/decanoic acid blend reacted (2) with a hydride terminated polysiloxane represented by the following formula

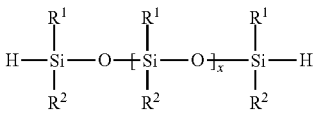

wherein $R^1$ and $R^2$ are methyl groups and x is approximately 10.

Another preferred silicone composition of this disclosure is an (1) ester of undecylenic acid reacted with a partial ester of trimethylolpropane with a linear octanoic/decanoic acid blend reacted (2) with a hydride terminated polysiloxane represented by the following formula

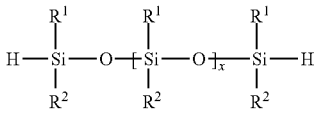

wherein $R^1$ and $R^2$ are methyl groups and x is approximately 100.

The antifoam agents can be used in an amount of about 0.01 to 5 weight percent, preferably about 0.01 to 1.5 weight percent, more preferably zero to less than 1.5 weight percent, more preferably zero to less than 1 weight percent.

Other Additives

The formulated lubricating oil useful in the present disclosure may additionally contain one or more of the other commonly used lubricating oil performance additives including but not limited to antiwear additives, dispersants, detergents, viscosity modifiers, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, demulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ramey, published by Noyes Data Corporation of Parkridge, N.J. (1973), see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives in oil can be dispersed in the lubricating oils of this disclosure.

The types and quantities of performance additives used in combination with the instant disclosure in lubricant compositions are not limited by the examples shown herein as illustrations.

Antiwear Additives

Illustrative antiwear additives useful in this disclosure include, for example, carboxylic acids and metal salts of a carboxylic acid. The metal is selected from a transition metal and mixtures thereof. The carboxylic acid is selected from an aliphatic carboxylic acid, a cycloaliphatic carboxylic acid, an aromatic carboxylic acid, and mixtures thereof.

The metal is preferably selected from Groups 2a to 5a, Groups 1b to 7b, and Group 8 of the elemental periodic table, and mixtures thereof. The carboxylic acid is preferably an aliphatic, saturated, unbranched carboxylic acid having from about 8 to about 26 carbon atoms, and mixtures thereof.

The metal is preferably selected from zinc (Zn), magnesium (Mg), nickel (Ni), palladium (Pd), platinum (Pt), copper (Cu), silver (Ag), gold (Au), bismuth (Bi), and mixtures thereof.

The carboxylic acid is preferably selected from caprylic acid (C8), pelargonic acid (C9), capric acid (C10), undecylic acid (C11), lauric acid (C12), tridecylic acid (C13), myristic acid (C14), pentadecylic acid (C15), palmitic acid (C16), margaric acid (C17), isostearic acid (C18), stearic acid (C18), nonadecylic acid (C19), arachidic acid (C20), heneicosylic acid (C21), behenic acid (C22), tricosylic acid (C23), lignoceric acid (C24), pentacosylic acid (C25), cerotic acid (C26), and mixtures thereof.

Preferably, the metal salt of a carboxylic acid comprises zinc stearate, magnesium stearate, silver stearate, palladium stearate, zinc palmitate, silver palmitate, palladium palmitate, bismuth stearate, bismuth palmitate, and mixtures thereof.

In the lubricating oils of this disclosure, the weight ratio of the at least one carboxylic acid or metal salt of a carboxylic acid to the at least one surfactant is from about 0.1:1 to about 1000:1, or from about 0.1:1 to about 100:1, or from about 0.1:1 to about 20:1, preferably from about 0.5:1 to about 20:1, and more preferably from about 1:1 to about 20:1. The concentration of the surfactant is preferably less than the concentration of the carboxylic acid or the metal salt of a carboxylic acid.

The carboxylic acid or metal salt of a carboxylic acid is present in the engine oil formulations of this disclosure in an amount of from about 0.001 weight percent to about 5 weight percent, based on the total weight of the formulated oil.

Low phosphorus engine oil formulations are included in this disclosure. For such formulations, the phosphorus content is typically less than about 0.12 weight percent, preferably less than about 0.10 weight percent, more preferably less than about 0.085 weight percent, and most preferably less than about 0.04 weight percent.

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl amyl groups may also be used.

Preferable zinc dithiophosphates which are commercially available include secondary zinc dithiophosphates such as those available from for example. The Lubrizol Corporation under the trade designations "LZ 677A", "LZ 1095" and "LZ 1371", from for example Chevron Oronite under the trade designation "OLOA 262" and from for example Afton Chemical wider the trade designation "HITEC 7169".

The ZDDP is typically used in amounts of from about 0.3 weight percent to about 1.5 weight percent, preferably from about 0.4 weight percent to about 1.2 weight percent, more preferably from about 0.5 weight percent to about 1.0 weight percent, and even more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322.670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and his-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethactylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or his-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 200 ppm by weight to about 2000 ppm by weight, preferably from about 200 ppm by weight to about 1200 ppm by weight. Basic nitrogen can vary from about 100 ppm by weight to about 1000 ppm by weight, preferably from about 100 ppm by weight to about 600 ppm by weight.

Dispersants as described herein are beneficially useful with the compositions of this disclosure and substitute for some or all of the surfactants of this disclosure. Further, in one embodiment, preparation of the compositions of this disclosure using one or more dispersants is achieved by combining ingredients of this disclosure, plus optional base stocks and lubricant additives, in a mixture at a temperature above the melting point of such ingredients, particularly that of the one or more M-carboxylates (M=H, metal, two or more metals, mixtures thereof).

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur-containing acid, carboxylic acid (e.g., salicylic acid), phosphorus-containing acid, phenol, or mixtures thereof. The counterion is typically an alkaline earth or alkali metal. The detergent can be overbased as described herein.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur-containing acid, a carboxylic acid, a phosphorus-containing acid, and mixtures thereof.

Preferably, the metal salt of an organic or inorganic acid or the metal salt of a phenol comprises calcium phenate, calcium sulfonate, calcium salicylate, magnesium phenate, magnesium sulfonate, magnesium salicylate, an overbased detergent, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Preferably the TBN delivered by the detergent is between 1 and 20. More preferably between 1 and 12. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

In accordance with this disclosure, metal salts of carboxylic acids are preferred detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

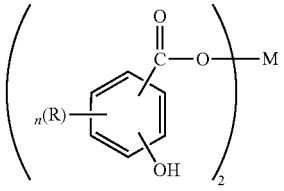

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, barium, or mixtures thereof. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate. Overbased detergents are also preferred.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Viscosity Modifiers

Viscosity modifiers (also known as viscosity index improvers (VI improvers), viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50.000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A–B wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the formulated oil or lubricating engine oil. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, amyl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthyl amines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 weight percent, preferably about 0.01 to 1.5 weight percent, more preferably zero to less than. 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Inhibitors and Antirust Additives

Antirust additives (or corrosion inhibitors) additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides polypropoxylated hydrocarbylamides and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, steatyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein are directed to the amount of active ingredient (that is the non-diluent portion of the ingredient). The weight percent wt % indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Antifoam | 0.01-5 | 0.01-1.5 |
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Formulations were prepared as described herein. All of the ingredients used herein are commercially available. The base stock used in the formulations was a 75:25 mixture of 100 cSt PAO:4 cSt PAO.

The antifoam additives of this disclosure used in the formulations were silicon ester D10 and silicon ester DI-100. The comparative antifoam additive used in the formulations was polydimethylsiloxane (PDMS).

The silicon ester D10 used in the formulations is an (1) ester of undecylenic acid reacted with a partial ester of trimethylolpropane with a linear octanoic/decanoic acid blend reacted (2) with a hydride terminated polysiloxane represented by the following formula

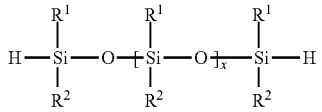

wherein $R^1$ and $R^2$ are methyl groups and x is approximately 10.

The silicon ester DI-100 used in the formulations is an (1) ester of undecylenic acid reacted with a partial ester of trimethylolpropane with a linear octanoic/decanoic acid blend reacted (2) with a hydride terminated polysiloxane represented by the following formula

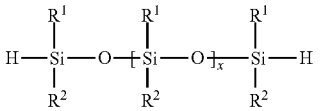

wherein $R^1$ and $R^2$ are methyl groups and x is approximately 100.

The silicon esters chosen for evaluation were DI-100 and D10 due to their high molecular weight and low PAO solubility, as oil-soluble silicones can act as pro-foaming additives. DI-100 and D10 were each used at 1 wt. % defoamant in carrier fluids of kerosene and TMP ester respectively to make the defoamant concentrates of this disclosure.

In order to show performance in the absence of additive interactions, defoamants were tested in a 75:25 mixture of 100 cSt PAO: 4 cSt PAO. This base stock combination is known to have poor baseline foam performance and a viscosity near ISO VG 460. In all experiments, a defoamant-free formulation was used as control and 1 wt. % of high molecular weight polydimethylsiloxanes (PDMS) in kerosene was used as a reference. The treat rate of the defoamant concentrate in all cases was 0.3 wt. % (corresponding to 30 ppm active defoamant) to allow for accurate quantification of the silicon content. Interfacial properties were measured in fresh oil to determine the presence of defoamant activity.

The formulations were subjected to 1000 cycles of filtration in a PTC Filterability Rig to simulate aging of the oil and enhance differentiation. Filtration was performed by circulating for the equivalent of 1000 cycles through a Hydac filter cartridge (Part #0060R010BN4HC) to measure the robustness of antifoam activity. Oils were tested before and after filtration for metals content, D892, Flender Foam, and Lube Oil Air Separability Test (LOAST). Results are summarized in FIG. 1.

As shown in FIG. 1, the defoamants DI-100 and D10 of this disclosure exhibited antifoam performance comparable to polydimethylsiloxanes (PDMS) in fresh oil foam performance tests. DI-100 and D10 are superior to PDMS in filterability in that they are not retained by standard filter material. Formulations containing DI-100 (and to a lesser extent D10) retain substantial antifoam performance post-filtration. Increasing hydrocarbon content of Si-based defoamants reduces haze in finished formulations. Silicone derivatized esters provide exceptional antifoam performance, reduce Si content (valuable for certain applications), and can improve filter compatibility.

Based on fresh oil testing, both the DI-100 and D10 defoamant concentrates showed antifoam performance similar to PDMS by LOAST, Flender Foam and ASTM D892, and provided significant benefit over the defoamant-free formulation. Although no published reproducibility exists for Flender Foam and LOAST, the uncertainty in these tests has been found to be about 2% absolute for low foaming lubricants and 10% of the measurement for high foaming lubricants. A benefit of the D10 defoamant is the relatively low silicon content. The silicon content is approximately one third the value of either PDMS or DI-100. This is due to the larger ratio of ester into the polymer, and is beneficial in applications where silicon content is discouraged, such as coating applications.

It is also evident that formulation appearance responds strongly to defoamant chemistry. Although the three defoamant-containing formulations contain the same wt. % of insolubles, the PDMS and DI-100 containing formulations are reported as "slightly hazy" while the defoamant-free and D10 formulations are "clear & bright." The refractive index of the high-organic content defoamant is likely much closer to the base stock refractive index than the high silicone defoamant. The defoamant with the lowest silicon content provides the highest clarity.

1000 cycle filtration in the PTC Filterability Rig was used to stress the oil and accelerate aging of the defoamant. The filtered oil was then subjected to the same array of foam performance tests to facilitate the comparison. Both the DI-100 and D10 outperformed PDMS in silicon retention post-filtration. This finding suggests the dominant mechanism of defoamant removal is by adsorption to filter material and not droplet size exclusion by pores in the filter material.

In addition to overall defoamant retention, foam performance is maintained post-filtration in formulations containing the silicone derivatized esters. This performance benefit is evidenced in the D10 formulation by the continued low ASTM D892 Seq. I values and intermediate LOAST results. The DI-100 formulation demonstrates the greatest performance retention, showing near fresh oil performance in D892 Seq. I, Flender Foam, and LOAST. Silicone based defoamants often lose D892 seq. II performance after filtration. This finding was confirmed in these tests.

The clear performance differentiation between the PDMS reference and the silicon derivatized defoamants, as shown in FIG. 1, demonstrates the foam performance achievable through organo-modified silicones. The silicone-derivatized ester technology shows potential both as a component in finished lubes and a tool to understand the fundamental science of defoamant activity. It can be concluded that end modification of PDMS w/ester moieties is a method of reducing removal by filter media while still maintaining the high performance of the PDMS core. High ester content also appears to show benefit in formulation clarity.

FIG. 1 is a summary of pre-filtration (top) and post-filtration (bottom) foam performance for formulations containing silicone derivatized ester defoamants of this disclosure versus PDMS reference and defoamant-free control.

FIG. 2 is pre-filtration (Blue) and post-filtration (Red) foam performance for formulations containing silicone derivatized ester defoamants of this disclosure versus PDMS reference and defoamant-free control.

The lubricant formulations of this disclosure depend on small amounts of the insoluble, silicone-based defoamants to provide optimal foam performance in a broad array of applications and environments. The insoluble material forms a dispersed phase which prevents the formation of stable foams. For ease of manufacture, defoamant materials may be dissolved in a carrier fluid to create a defoamant concentrate. Defoamant concentrates are then used to promote emulsion formation in-situ through the solvent displacement method during lubricant blending. Although typical formulations contain 0.05-0.50 wt. % of defoamant concentrate, the total insoluble defoamant is often less than 100 ppm, making the defoamant one of the most potent and complex performance additives within a lubricant formulation.

PCT and EP Clauses:

1. A method for improving filterability, while maintaining or improving antifoaming performance, of a lubricating oil in an engine or other mechanical component lubricated with the lubricating oil by using as the lubricating oil a formulated oil, said formulated oil having a composition comprising a lubricating oil base stock as a major component; and at least one antifoam agent, as a minor component; wherein the antifoam agent comprises a silicone composition having the formula:

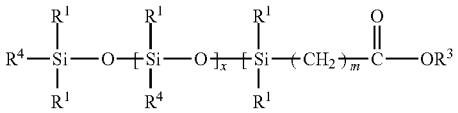

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

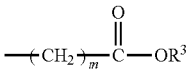

and a reverse ester thereof represented by the formula:

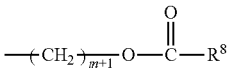

and the formula:

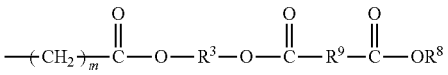

and a reverse ester thereof represented by the formula:

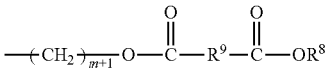

provided that if $R^1$ is anything but methyl or ethyl, then $R^2$ must be a methyl, ethyl or butyl. $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said compound derived from reverse esters thereof, in is an integer between 5 to 22; and x is an integer between 0 to 1000; wherein said composition has at least 1 compound derived from said partially esterified ester-containing group or said reverse ester thereof.

2. A method for improving antifoaming performance, while maintaining or improving filterability, of a lubricating oil in an engine or other mechanical component lubricated with the lubricating oil by using as the lubricating oil a formulated oil, said formulated oil having a composition comprising a lubricating oil base stock as a major component; and at least one antifoam agent, as a minor component; wherein the antifoam agent comprises a silicone composition having the formula:

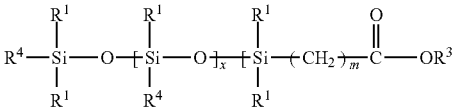

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

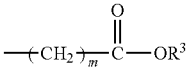

and a reverse ester thereof represented by the formula:

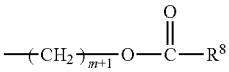

and the formula:

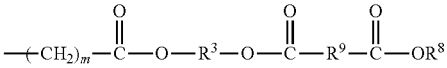

and a reverse ester thereof represented by the formula:

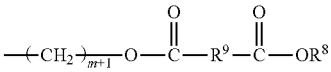

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said compound derived from reverse esters thereof, in is an integer between 5 to 22; and x is an integer between 0 to 1000; wherein said composition has at least 1 compound derived from said partially esterified ester-containing group or said reverse ester thereof.

3. A lubricating oil having a composition comprising a lubricating oil base stock as a major component; and at least one antifoam agent, as a minor component; wherein the antifoam agent comprises a silicone composition having the formula:

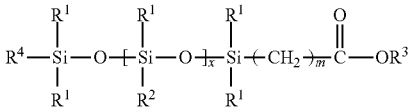

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

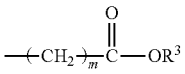

and a reverse ester thereof represented by the formula:

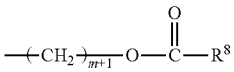

and the formula:

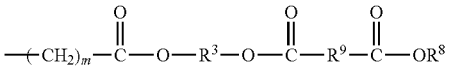

and a reverse ester thereof represented by the formula:

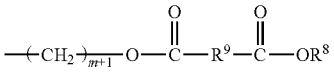

provided that if $R^1$ is anything but methyl or ethyl, then $R^2$ must be a methyl, ethyl or butyl, $R^3$ is derived from a partially esterified ester residue; $R^8$ is selected from the group consisting of hydrogen, alkyl of 1 to 45 carbon atoms, substituted alkyl of 1 to 45 carbon atoms optionally substituted by one or more fluorine atoms, aryl and a compound derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said compound derived from reverse esters thereof, in is an integer between 5 to 22; and x is an integer between 0 to 1000; wherein said composition has at least 1 compound derived from said partially esterified ester-containing group or said reverse ester thereof.

4. The method of clauses 1 and 2 and the lubricating oil of clause 3 wherein $R^1$ and $R^2$ are both methyl groups, m is an integer between 10 to 14, and x is an integer in the range between 6 to 110.

5. The method of clauses 1 and 2 and the lubricating oil of clause 3 wherein said compound derived from said partially esterified ester residue is a partially esterified alcohol or a partially esterified acid.

6, The method of clause 5 and the lubricating oil of clause 5 wherein said partially esterified alcohol is derived from di-, tri- or tetra-functional alcohol represented by the formula:

$$R^5(OH)_n$$

wherein: $R^5$ is an n-functional hydrocarbon; and n is from 2 to 8; and wherein said partially esterified acid is derived from di-, tri- or tetra-functional acids.

7. The method of clause 6 and the lubricating oil of clause 6 wherein said functional alcohol is selected from the group consisting of: ethylene glycol, propylene glycol, butylene glycol, polyethylene glycol, neopentyl glycol, polypropylene glycol, glycerin, trimethylolethane, trimethylolpropane, pentaerythritol, di-pentaerythritol, tri-pentaerythritol, and mixtures thereof; an said functional acid is selected from the group consisting of: adipic acid, azelaic acid, sebacic acid, dodecanedioc acid, succinic acid, glutaric acid, maleic acid, phthalic acid, trimellitic acid, nadic acid, methyl nadic acid, hexahydrophthalic acid, and mixtures thereof.

8. The method of clauses 1 and 2 and the lubricating oil of clause 3 wherein $R^4$ is methyl group; or $R^4$ is a group represented by the formula:

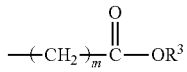

wherein: $R^3$ is a compound derived from a partially esterified ester residue; m is an integer in the range between 5 to 22; and x is an integer in the range between 0 to 1000, or a reverse ester thereof represented by the formula:

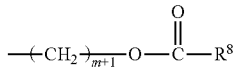

9. The method of clauses 1 and 2 and the lubricating oil of clause 3 wherein said silicone composition is represented by the formula:

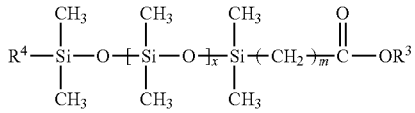

wherein: $R^4$ is selected from the group consisting of methyl and a group represented by the formula:

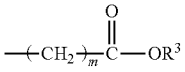

$R^3$ is a compound derived from a partial ester residue; m is 10; and x is an integer in the range between 0 to 1000.

10. The method of clause 9 and the lubricating oil of clause 9 wherein $R^4$ is a group represented by the formula:

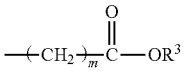

wherein $R^3$ is a compound derived from a partially esterified ester residue.

11. The method of clauses 1 and 2 and the lubricating oil of clause 3 wherein said silicone composition has the formula:

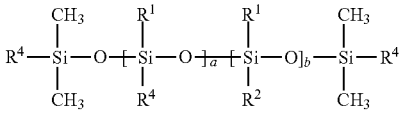

wherein $R^4$ is selected from the group consisting of: alkyl and a group represented by the formula:

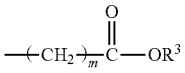

wherein: a is an integer in the range between 1 to 20; b is an integer in the range between 0 to 1000; $R^3$ is a compound derived from a partially esterified ester residue; and m is an integer in the range between 5 to 22; with the proviso that the $R^4$ groups are not all alkyls; or wherein said silicone composition has the formula:

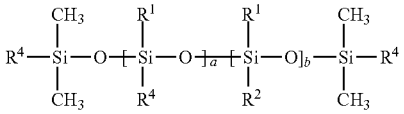

wherein $R^1$, $R^2$ and $R^4$ are selected from the group consisting of methyl, and a group represented by the formula:

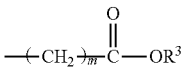

a is 40, b is 4, m is 10, and $R^3$ is derived from a hydroxyl-terminated partially esterified ester of trimethylolpropane with a linear octanoic/decanoic acid blend; or wherein said silicone composition has the formula:

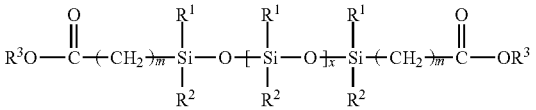

wherein x is 98, m is 10, $R^1$ and $R^2$ are methyl groups, and $R^3$ is a linear $C_8$ to $C_{10}$ acid partially esterified with trimethylolpropane and a linear octanoic/decanoic acid blend.

12. The method of clauses 1 and 2 and the lubricating oil of clause 3 wherein said silicone composition is an (1) ester of undecylenic acid reacted with a partial ester of trimethylolpropane with a linear octanoic/decanoic acid blend reacted (2) with a hydride terminated polysiloxane represented by the following formula.

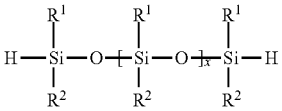

wherein $R^1$ and $R^2$ are methyl groups and x is approximately 10 or 100.

13. The method of clauses 1 and 2 wherein filterability is improved, and antifoam performance is maintained or improved, as compared to filterability and antifoam performance achieved using a lubricating oil containing a minor component other than the antifoam agent; or wherein antifoam performance is improved, and filterability is maintained or improved, as compared to antifoam performance and filterability achieved using a lubricating oil containing a minor component other than the antifoam agent.

14 The method of clauses 1 and 2 wherein antifoam performance is improved or maintained post-filtration.

15. The method of clauses 1 and 2 wherein increasing hydrocarbon content of the silicone composition reduces haze in the formulated oil; or wherein the silicone composition improves filter compatibility.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for improving filterability, while maintaining or improving antifoaming performance, of a lubricating oil in an engine or other mechanical component lubricated with the lubricating oil by using as the lubricating oil a formulated oil, said formulated oil having a composition comprising a lubricating oil base stock as a major component; and at least one antifoam agent, as a minor component; wherein the antifoam agent comprises a silicone composition having the formula:

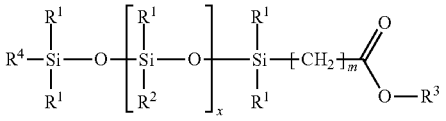

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

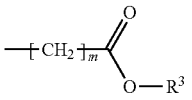

and a reverse ester thereof represented by the formula:

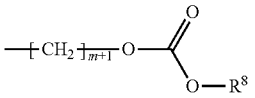

and the formula:

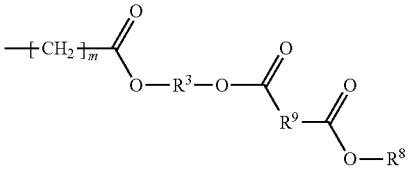

and a reverse ester thereof represented by the formula:

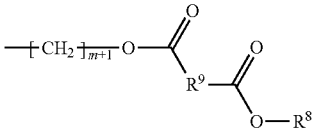

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a group derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said group derived from reverse esters thereof, m is an integer between about 5 to about 22; and x is an integer between about 0 to about 1000; wherein said composition has at least 1 compound derived from said partially esterified ester-containing group or said reverse ester thereof; and wherein the antifoam agent is provided to the formulated oil in the form of a defoamant concentrate present in an amount of from about 0.05 weight percent to about 0.5 weight percent, based on the total weight of the formulated oil, to yield less than 100 ppm of total insoluble defoamant to the lubricating oil.

2. The method of claim 1 wherein $R^1$ and $R^2$ are both methyl groups.

3. The method of claim 1 wherein m is an integer between about 10 to about 14.

4. The method of claim 1 wherein x is an integer in the range between about 6 to about 110.

5. The method of claim 1 wherein said group derived from said partially esterified ester residue is a mono-hydroxy-terminated partially esterified alcohol.

6. The method of claim 5 wherein said mono-hydroxy-terminated partially esterified alcohol is derived from di-, tri- or tetra-functional alcohol represented by the formula:

$$R^5(OH)_n$$

wherein: $R^5$ is an n-functional hydrocarbon; and n is from about 2 to about 8.

7. The method of claim 6 wherein said functional alcohol is selected from the group consisting of: ethylene glycol, propylene glycol, butylene glycol, polyethylene glycol, neopentyl glycol, polypropylene glycol, glycerin, trimethylolethane, trimethylolpropane, pentaerythritol, di-pentaerythritol, tri-pentaerythritol, and a mixture thereof.

8. The method of claim 1 wherein said group derived from said partially esterified ester residue is a mono-hydroxy-terminated partially esterified acid.

9. The method of claim 8 wherein said mono-hydroxy-terminated partially esterified acid is derived from di-, tri- or tetra-functional acids.

10. The method of claim 9 wherein said functional acid is selected from the group consisting of: adipic acid, azelaic acid, sebacic acid, dodecanedioc acid, succinic acid, glutaric acid, maleic acid, phthalic acid, trimellitic acid, nadic acid, methyl nadic acid, hexahydrophthalic acid and mixtures thereof.

11. The method of claim 1 wherein $R^4$ is methyl group.

12. The method of claim 1 wherein $R^4$ is a group represented by the formula:

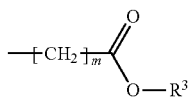

wherein: $R^3$ is a group derived from a partially esterified ester residue; m is an integer in the range between about 5 to about 22; and x is an integer in the range between about 0 to about 1000, or a reverse ester thereof represented by the formula:

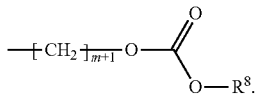

13. The method of claim 1 wherein the antifoam agent is represented by the formula:

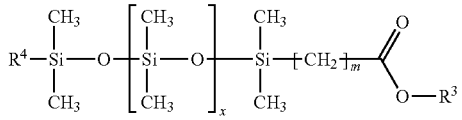

wherein: $R^4$ is selected from the group consisting of methyl and a group represented by the formula:

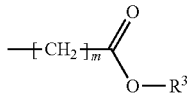

$R^3$ is a group derived from a partial ester residue; m is 10; and x is an integer in the range between about 0 to about 1000.

14. The method of claim 13 wherein $R^4$ is a group represented by the formula:

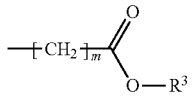

wherein $R^3$ is a group derived from a partially esterified ester residue.

15. The method of claim 1 wherein said silicone composition has the formula:

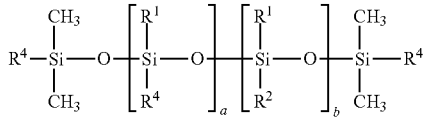

wherein $R^4$ is selected from the group consisting of: alkyl and a group represented by the formula:

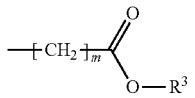

wherein: a is an integer in the range between about 1 to about 20; b is an integer in the range between about 0 to about 1000; $R^3$ is a group derived from a partially esterified ester residue; and m is an integer in the range between about 5 to about 22; with the proviso that the $R^4$ groups are not all alkyls.

16. The method of claim 1 wherein said silicone composition has the formula:

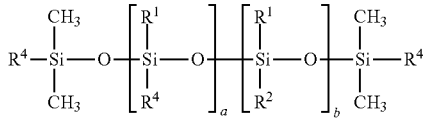

wherein $R^1$, $R^2$ and $R^4$ are selected from the group consisting of methyl, and a group represented by the formula:

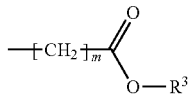

a is 40, b is 4, m is 10, and $R^3$ is derived from a hydroxyl-terminated partially esterified ester of trimethylolpropane with a linear octanoic/decanoic acid blend.

17. The method of claim 1 wherein said silicone composition has the formula:

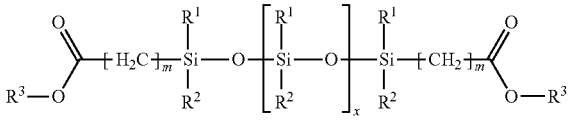

wherein x is about 98, m is 10, $R^1$ and $R^2$ are methyl groups, and $R^3$ is a linear $C_8$ to $C_{10}$ acid partially esterified with trimethylolpropane and a linear octanoic/decanoic acid blend.

18. The method of claim 1 wherein said silicone composition is an (1) ester of undecylenic acid reacted with a partial ester of trimethylolpropane with a linear octanoic/decanoic acid blend reacted (2) with a hydride terminated polysiloxane represented by the following formula

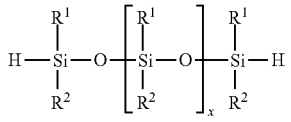

wherein $R^1$ and $R^2$ are methyl groups and x is approximately 10.

19. The method of claim 1 wherein said silicone composition is an (1) ester of undecylenic acid reacted with a partial ester of trimethylolpropane with a linear octanoic/decanoic acid blend reacted (2) with a hydride terminated polysiloxane represented by the following formula

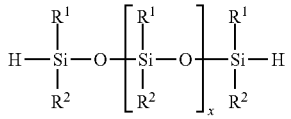

wherein $R^1$ and $R^2$ are methyl groups and x is approximately 100.

20. The method of claim 1 wherein the formulated oil further comprises one or more of an antiwear additive, thickener, viscosity modifier, antioxidant, detergent, dispersant, pour point depressant, corrosion inhibitor, metal deactivator, seal compatibility additive, inhibitor, extreme pressure agent, demulsifier, haze inhibitor, metal passivator, and anti-rust additive.

21. The method of claim 1 wherein said composition is formulated so as to be suitable for use as an automotive gear lubricating composition.

22. The method of claim 1 wherein the lubricating oil base stock comprises a Group I, Group II, Group III, Group IV or Group V base oil.

23. The method of claim 1 wherein the lubricating oil base stock is present in an amount of from about 80 weight percent to about 99.5 weight percent, based on the total weight of the formulated oil.

24. The method of claim 23 wherein filterability is improved, and antifoam performance is maintained or improved, as compared to filterability and antifoam performance achieved using a lubricating oil containing a minor component other than the antifoam agent.

25. The method of claim 1 wherein antifoam performance is improved or maintained post-filtration.

26. The method of claim 1 wherein increasing hydrocarbon content of the silicone composition reduces haze in the formulated oil.

27. The method of claim 1 wherein the silicone composition improves filter compatibility.

28. A lubricating oil having a composition comprising a lubricating oil base stock as a major component; and at least one antifoam agent, as a minor component; wherein the antifoam agent comprises a silicone composition having the formula:

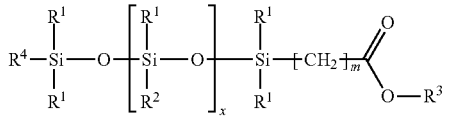

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

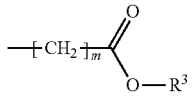

and a reverse ester thereof represented by the formula:

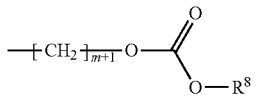

and the formula:

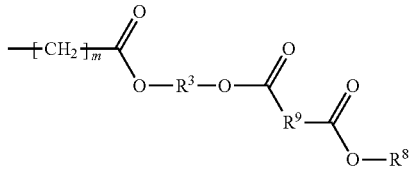

and a reverse ester thereof represented by the formula:

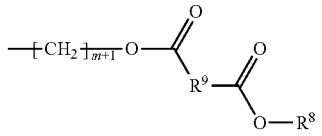

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a group derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said group derived from reverse esters thereof, m is an integer between about 5 to about 22; and x is an integer between about 0 to about 1000; wherein said composition has at least 1 compound derived from said partially esterified ester-containing group or said reverse ester thereof; and wherein the antifoam agent is provided to the lubricating oil in the form of a defoamant concentrate present in an amount of from about 0.05 weight percent to about 0.5 weight percent, based on the total weight of the lubricating oil, to yield less than 100 ppm of total insoluble defoamant to the lubricating oil.

29. A method for improving antifoaming performance, while maintaining or improving filterability, of a lubricating oil in an engine or other mechanical component lubricated with the lubricating oil by using as the lubricating oil a formulated oil, said formulated oil having a composition comprising a lubricating oil base stock as a major component; and at least one antifoam agent, as a minor component; wherein the antifoam agent comprises a silicone composition having the formula:

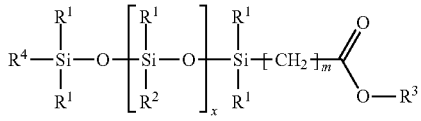

wherein: $R^1$ are independently selected from the group consisting of: an alkyl having 1-5 carbon atoms, a substituted alkyl having 1-5 carbon atoms optionally substituted by one or more fluorine atoms, and a phenyl, and $R^2$ is selected from the group consisting of: hydrogen, alkyl of 1 to 45 carbon atoms, substituted alkyl of 1 to 45 carbon atoms optionally substituted by one or more fluorine atoms, aryl, a partially esterified ester-containing group represented by the formula:

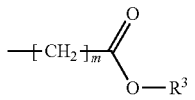

and a reverse ester thereof represented by the formula:

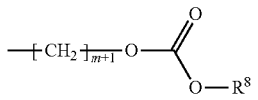

and the formula:

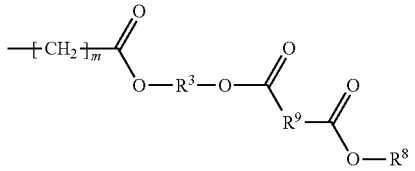

and a reverse ester thereof represented by the formula:

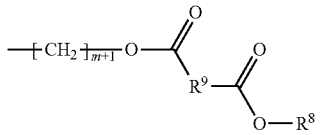

provided that if $R^1$ is anything but methyl or ethyl, then $R^2$ must be a methyl, ethyl or butyl, $R^3$ is derived from a partially esterified ester residue; $R^8$ is selected from the group consisting of: hydrogen, alkyl of 1 to 45 carbon atoms, substituted alkyl of 1 to 45 carbon atoms optionally substituted by one or more fluorine atoms, aryl and a group derived from a partially esterified ester residue; $R^9$ is selected from the group consisting of: an arylene, an alkylene of 1 to 22 carbon atoms, substituted alkylene of 1 to 22 carbon atoms optionally substituted by one or more fluorine atoms and arylene; $R^4$ is selected from the group consisting of: alkyl of 1 to 45 carbon atoms, substituted alkyl of 1 to 45 carbon atoms optionally substituted by one or more fluorine atoms, aryl, said ester-containing group and said group derived from reverse esters thereof, m is an integer between about 5 to about 22; and x is an integer between about 0 to about 1000; wherein said composition has at least 1 compound derived from said partially esterified ester-containing group or said reverse ester thereof; and wherein the antifoam agent is provided to the lubricating oil in the form of a defoamant concentrate present in an amount of from about 0.05 weight percent to about 0.5 weight percent, based on the total weight of the lubricating oil, to yield less than 100 ppm of total insoluble defoamant to the lubricating oil.

30. The method of claim 29 wherein antifoam performance is improved, and filterability is maintained or improved, as compared to antifoam performance and filterability achieved using a lubricating oil containing a minor component other than the antifoam agent.

* * * * *